United States Patent [19]

Eguchi

[11] 4,073,253

[45] Feb. 14, 1978

[54] INTERMITTENT STITCHING DEVICE OF SEWING MACHINES

[75] Inventor: Yasukata Eguchi, Kunitachi, Japan

[73] Assignee: Janome Sewing Machine Co., Ltd., Tokyo, Japan

[21] Appl. No.: 570,701

[22] Filed: Apr. 23, 1975

[30] Foreign Application Priority Data

May 2, 1974 Japan ..... 49-48757

[51] Int. Cl.[2] ..... D05B 69/22

[52] U.S. Cl. ..... 112/275

[58] Field of Search ..... 112/219 A, 219 R, 220, 112/67, 87; 192/102, 138, 139, 142 R

[56] References Cited

U.S. PATENT DOCUMENTS

| | | | |
|---|---|---|---|
| 2,863,411 | 12/1958 | Peets | 112/220 |
| 3,388,681 | 6/1968 | Fujita | 112/220 |
| 3,780,681 | 12/1973 | Sasaki | 112/219 A |
| 3,793,566 | 2/1974 | Mailaender | 112/219 A X |

*Primary Examiner*—H. Hampton Hunter

*Attorney, Agent, or Firm*—Michael J. Striker

[57] ABSTRACT

In a sewing machine having an electric motor and a foot control unit for driving the sewing machine, an intermittent stitching device which comprises a clutch device provided on the upper shaft, a clutch releasing device including an electromagnet and an electric control circuit for energizing the electric motor and the electromagnet via the foot controller, the electric motor and the electromagnet are energized and deenergized simultaneously by the operation of the foot control unit and to thereby intermittently cause rotation of the upper shaft of the sewing machine for producing intermittent stitches.

14 Claims, 8 Drawing Figures

INTERMITTENT STITCHING DEVICE OF SEWING MACHINES

BACKGROUND OF THE INVENTION

With recent popularity of zigzag sewing machines and with the advance in their mechanisms as well as in their function, it has become desirous that the sewing machines be intermittently driven to make intermittent stitches, while preserving the conventional function of the sewing machine to produce the ordinary continuous stitches.

SUMMARY OF THE INVENTION

The present invention has been devised to provide a sewing machine which can produce intermittent stitches without any adverse influence on the conventional functions of the sewing machine.

It is the primary object of the invention to provide a sewing machine with a clutch releasing device including an electromagnet which is energized simultaneously with the machine motor to act on the clutch mechanism on the upper main shaft of the sewing machine so that the upper shaft may be stopped in a predetermined angular position after revolution thereof to produce intermittent stitches.

It is another object of the invention to provide a switch device manually operable by a foot actuable control unit to connect the machine motor and the electromagnet selectively to a source of electrical energy, so that the machine motor and the electromagnet may be simultaneously energized and deenergized by the operation of the foot control unit.

It is a further object of the invention to provide an electric control circuit having a first stage for energizing the machine motor and a second stage for energizing the machine motor and the electromagnet simultaneously when the foot control unit is operated.

Many other features and characteristics of the present invention will be apparent from the following description of the embodiment of the invention with reference to the attached drawings,

BRIEF DESCRIPTION OF THE DRAWING

Referring now to the drawings, it may be seen that.

DESCRIPTION OF THE PREFERRED EMBODIMENT

Figure 1:
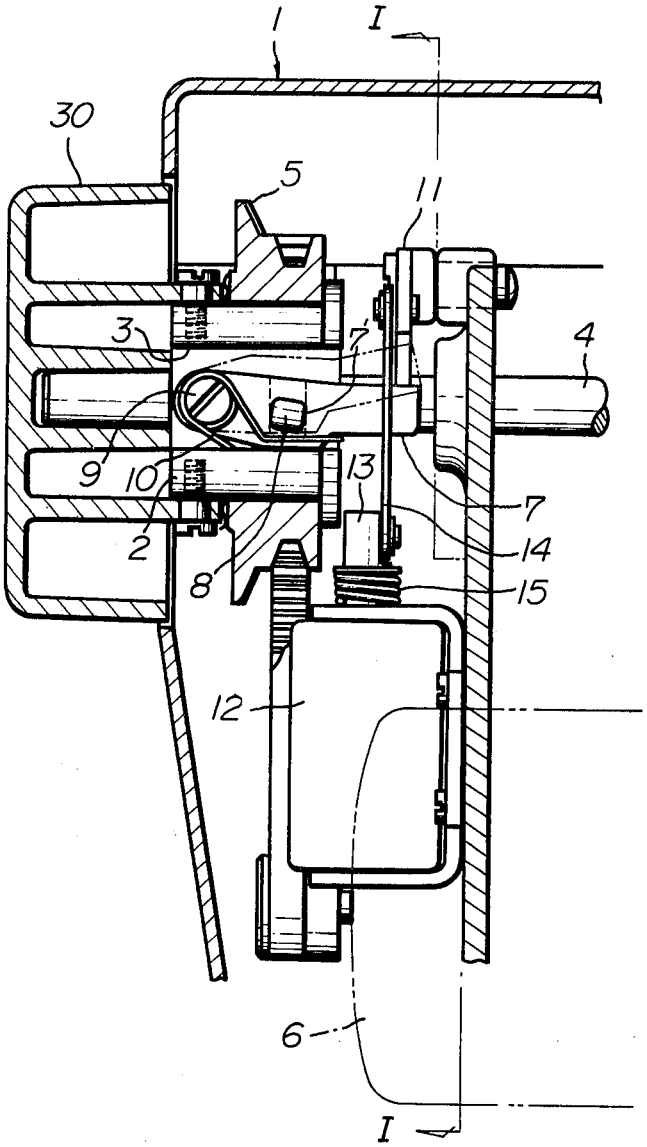
FIG. 1 is a rear side view of one end portion of a sewing machine head which is shown in an elevational cross section as provided with an intermittent stitching device according to the present invention.
Figure 2:
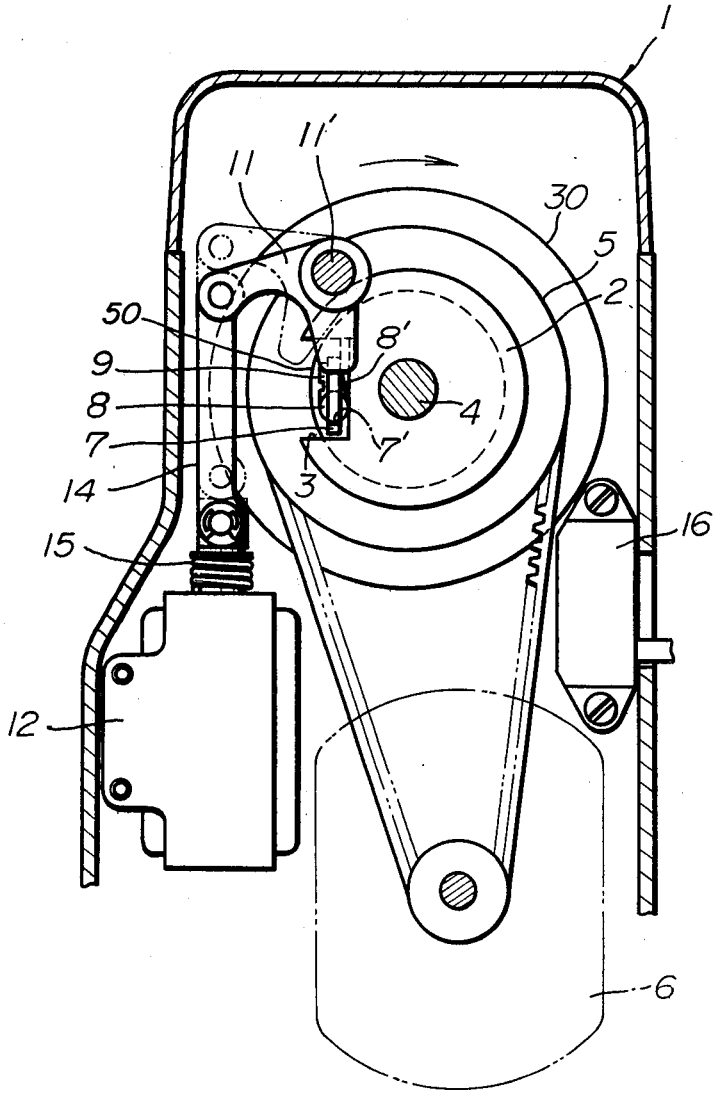
FIG. 2 is an elevational cross sectional view taken on line marked by letters I —I in FIG. 1.
Figure 2A:
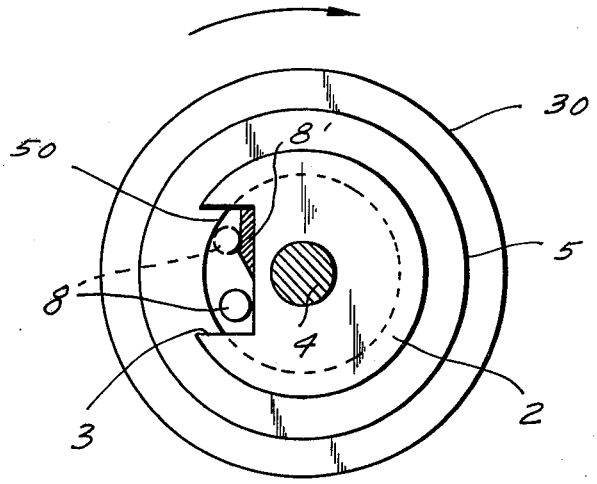
FIG. 2*a* is a diagrammatic, enlarged view of a detail of FIG. 2.

FIGS. 1 and 2, illustrate a machine frame 1 of a sewing machine. A bushing 2 is coaxially fixed on one end portion of the upper shaft 4 of the machine adjacent the machine pulley 30 and is connected thereto. The bushing 2 is formed with a transverse groove 3 parallel to the upper shaft 4. A belt wheel having an inner surface 50 is mounted on the bushing 2. The belt wheel is arranged to be driven by an electrical motor 6 and is rotatable relative to the bushing 2. A first lever 7 is pivotally mounted on a screw 9 at one end thereof in the groove 3 of the bushing 2 and is biased in the counterclockwise direction by means of a torsion spring 10 which spring is mounted on a screw 9 and abuts at its one end on the lower side wall of the groove 3 and engages at its other end thereof the lever 7. The lever 7 has formed in its intermediate portion with a cut-out 7′ wherein a roller 8 mounted in the groove 3 of the bushing 2. The roller 8 may be moved up and down in the groove 3 during the pivoting movement of the lever 7 this movement occurring between the position shown in a solid line and the position shown in a dotted line in FIG. 1. A guide plate 8′ of a proper thickness is fixedly attached to the upper part of the vertical wall of the groove 3. The guide plate 8′ is formed with an inclined edge at the lower end thereof for guiding the roller 8 when it is moved upwardly in the groove 3. The roller 8 acts as a clutch to connect the bushing 2 to the belt wheel 5 when it is moved upwardly by the lever 7 to the position shown in a dotted line in FIG. 2*a* in which the roller 8 frictionally engages and contacts both the inner surface 50 of the wheel 5 and the guide plate 8′ of the bushing 2. When the roller 8 is moved downwardly to the position shown in solid line in FIG. 2*a*, it disconnects the bushing 2 from the belt wheel 5. A second actuating lever 11 has an intermediate portion which is turnably mounted on a pin 11′ fixed to the machine frame 1. This actuating lever 11 has two arms extending from the intermediate portion thereof in angular relationship with one another. One of these arms reaches proximate to the first lever 7 and is spaced therefrom such that, when this one arm is moved, it pivots the first lever 7 to declutch the bushing 2 from the belt wheel 5. The other arm of the actuating lever 11 is connected by means of a connecting rod 14 to a movable shaft or armature 13 of an electromagnet 12 which is provided in the lower part of the machine frame 1. The movable shaft 13 is with a return spring 15 biasing the shaft 13 in the upward direction. A switching device 16 is provided for switching a control circuit for the ordinary continuous stitching at high or low speed and for an intermittent stitching.

FIGS. 3 to 7 are diagrams of five various controlling circuitries arranged to operate the stitching device according to the invention.

Figure 3:
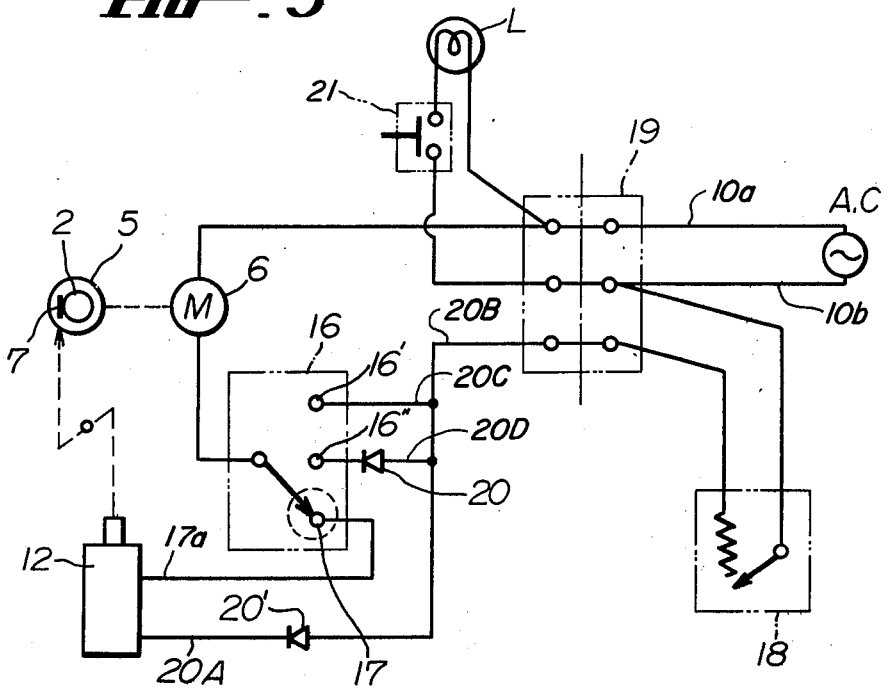
FIG. 3 is a diagrammatical illustration of an electric control circuit for the intermittent stitching device of the invention.

The circuit illustrated in FIG. 3 includes a pair of conductors 10*a* and 10*b* connected from an AC source to a power distributing three-step device 19. Via this device 19, the first pole conductor 10*a* is connected directly to the electric motor 6. The second pole conductor 10*b* is first led to a foot control unit 18 including a flop switch and via a further conductor 20B to the various stages of the controlling circuitry and to elements of the stitching device. This conductor 20B is connected to a switching device 16 comprising a high speed switch 16′ and a low speed switch 16″. This connection is effected in parallel by a first branch lead 20C to the high speed switch 16' and by a second branch lead 20D across a first diode 20 to the low speed switch 16''. From the connecting points of the first and second branch leads 20C and 20D, the conductor 20B continues to a second diode 20' and therefrom as a connecting lead 20A to the electromagnet 12. The first pole conductor 10*a* is connected to the electromagnet 12 in series with, and via, the electric motor 6, the intermittent switch 17 and a lead 17*a*. In this controlling circuitry, also a signal lamp L is provided which is connectable to the AC source via the three-step plug device 19 directly across a switching unit 21.

Resistors instead of diodes may be associated with the electric motor 6 which drives the belt wheel 5. The electromagnet 12 is associated with, and actuates, the first lever 7 embracing the roller 8. This connection is provided by a connecting rod 14 and the actuating lever 11.

Figure 4:
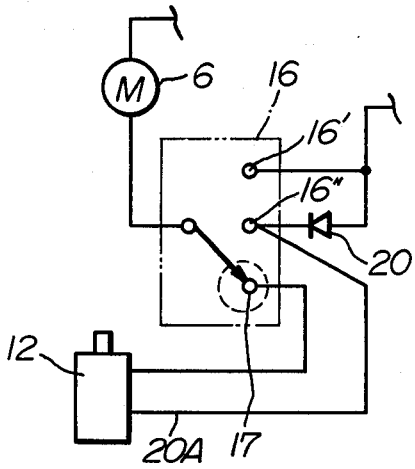
FIG. 4 is a diagrammatical illustration of another electric control circuit according to the present invention.
Figure 5:
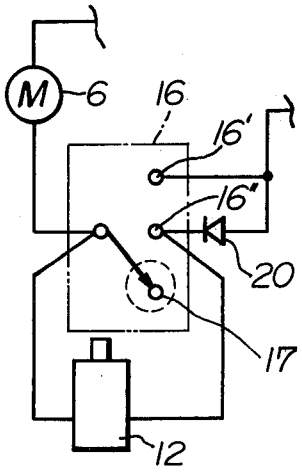
FIG. 5 is a diagrammatical illustration of a third embodiment of an electric control circuit according to the present invention.
Figure 6:
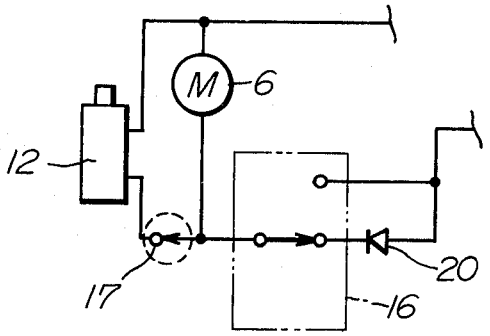
FIG. 6 is a diagrammatical illustration of a fourth embodiment of an electric control circuit according to the present invention.
Figure 7:
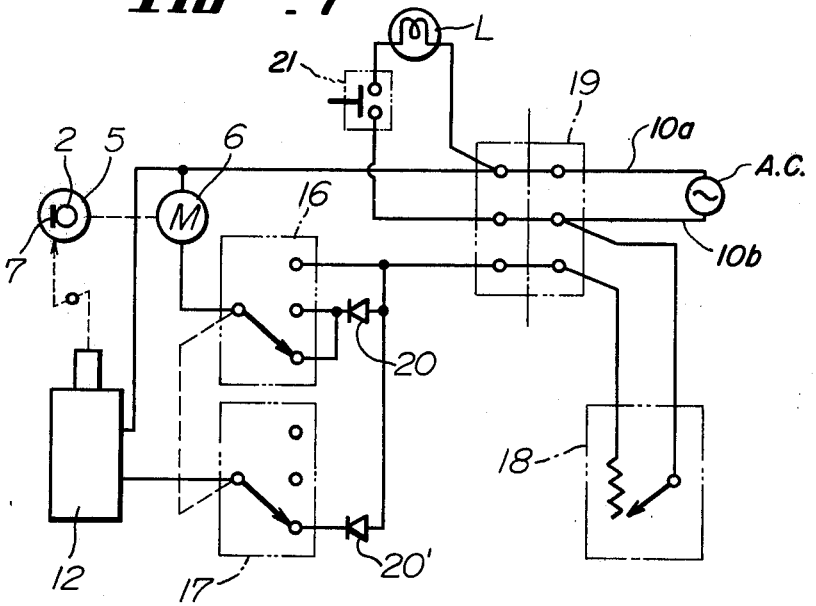
FIG. 7 is a diagrammatical illustration of a fifth embodiment of an electric control circuit according to the present invention.

FIG. 4 shows a controlling circuit of another embodiment according to the present invention in which the diode 20' shown in FIG. 3 is omitted and the connecting lead 20A to the electromagnet 12 is coupled directly to the low speed switch 16''. FIG. 5 shows a controlling circuit of a further embodiment in which the end terminals of the electromagnet 12 are coupled to form a short circuit when the high speed switch 16' or the low speed switch 16'' for the ordinary continuous stitching is switched on. FIG. 6 shows a controlling circuit of yet another embodiment. Here, the switch 17 for the intermittent stitching is separated from the switching device 16 and is independently operated. FIG. 7 shows a controlling circuit of still another embodiment. In this embodiment, a pair of three-step switching devices 16 and 17 are provided for separately controlling respectively a circuit for the electric motor 6 and a circuit for the electromagnet 12 respectively. These switching devices 16 and 17 are coupled to each other and are arranged to be operated in common by a single knob (not shown) in three steps for the ordinary continuous stitchings of high and low speed and for the intermittent stitching. In all the control circuits as shown in FIGS. 3 to 7, the intermittent stitching switch 17 is switched on. These circuits as shown are all so formed as to energize and deenergize the electromagnet 12 and the machine motor 6 simultaneously each time when the foot control unit 18 is pressed and released.

The device of the invention is constructed as mentioned above, will be now discussed in regard to its operation. When the high speed switch 16' or the low speed switch is switched on 16'', the electromagnet 12 becomes deenergized and the actuating lever 11 is shifted to its inoperative position shown in a dotted line. This occurs by the action of the return spring 15 shown in FIG. 2. In this condition, the roller 8 is upwardly moved together with the lever 7 by means of the torsion spring 10 to the position shown in a dotted line in FIG. 1. In this position the roller 8 acts as a clutch to frictionally engage the bushing 2 with the belt wheel 5. Therefore, when the pedal of the foot control unit 18 is pressed down, the rotational movement of the belt wheel 5 is transmitted to the bushing 2 and the upper shaft 4 of the sewing machine is continuously rotated to produce ordinary continuous seams, while the electromagnet 12 remains deenergized.

In the next step, when the intermittent stitching switch 17 is switched on and the foot control unit 18 is pressed, the electromagnet 12 becomes energized, and the movable shaft 13 of the electromagnet 12 is pulled down against the action of its return spring 15, and as a result, thereof the actuating lever 11 is turned in counterclockwise direction around the pin 11', and, thus, the actuating lever 11 is shifted to a position across the path of the pivotable lever 7 as shown in a solid line in FIG. 2. In this condition, the bushing 2 and correspondingly the upper shaft 4 are released or declutched from the belt wheel 5. Thus the upper shaft 4 can be stopped at a predetermined angular position where, for example, the needle of the sewing machine is stopped at the upper dead point thereof. The shock at the stopping time of the upper shaft 4 is absorbed by the torsion spring 10 acting on the lever 7.

Thereafter, when the foot control unit 18 is released, the motor 6 is stopped, as also is the belt wheel 5, and the electromagnet 12 becomes deenergized so that the actuating lever 11 returns to the inoperative position shown in the dotted line in FIG. 2 in response here, to the clutch lever 7 is moved upward to the position shown in the dotted line in FIG. 1, and the upper shaft 4 is again connected to the belt wheel 5.

When the foot control unit 18 is pressed again, the motor 6 and the electromagnet 12 are energized simultaneously, and the actuating lever 11 is on the way to the operative position shown in the solid line in FIG. 2, but the clutch lever 7, which is now in the upper position in the groove 3 as shown in the dotted line in FIG. 1, is not affected by the actuating lever 11, so that the upper shaft 4 is rotated together with the belt wheel 5. After after one rotation of the upper shaft 4, namely, after one stitch is sewn by the needle, the upper shaft 4 is stopped at a predetermined angular position by the actuating lever 11 which has completely returned to the operative position.

According to this invention, each time when the foot control unit 18 is pressed and released while the intermittent stitching switch 17 is switched on, the upper shaft 4 of the sewing machine is automatically stopped after one intermittent stitching has been sewn, and while the needle is stopped in the upper dead point thereof where it is spaced from the cloth treated, the cloth may be freely dealt with by the operator's hands, so that a basting or tacking stitching may be carried out efficiently. In addition, according to the invention, the stopping device, namely, the clutching device is operated by means of the electromagnet 12 which is electrically energized and deenergized simultaneously with the electric motor by pressing down the foot control unit 18. Therefore, it will be apparent that the intermittent stitching operation is very easy.

I claim:

1. In a sewing machine of the type having both continuous and intermittent modes of operation, a combination comprising means for mounting a top shaft for rotation in the machine; energizable drive means for rotating the shaft; coupling means intermediate the shaft and said drive means and being movable between a disengaged state in which intermittent operation occurs, and an engaged state in which said drive means is in motion-transmitting engagement with the shaft for continuous operation; energizable actuating means having an armature movable between a deenergized condition and an energized condition; decoupling means connected to and movable by said armature from a first position in which said coupling means is in said engaged state when said actuating means is in said deenergized condition, to a second position in which said actuating means is in said energized condition and said coupling means is in said disengaged state upon elapse of a time interval following energization of said actuating means; and switching means connected to said drive means and said actuating means and operative for energizing only said drive means in a first switching position for continuous operation, and for energizing both said drive means and said actuating means in a substantially simultaneous manner in a second switching position for intermittent operation.

2. A combination as defined in claim 1, wherein said time interval elapses after one rotation of the top shaft.

3. In a sewing machine of the type having a stitching needle coupled to a top shaft so as to be driven by the same, a combination comprising means for mounting the top shaft for rotation in the machine; drive means for rotating the shaft; coupling means intermediate the shaft and said drive means for normally connecting the latter in motion-transmitting engagement with the shaft, said coupling means comprising a pair of clutch elements disposed intermediate the shaft and said drive means, a movable engaging element located intermediate said clutch elements, and means for mounting said engaging element for movement between respective positions in which said engaging element is in and out of frictional engagement with said clutch elements; switching means for actuating and deactuating said drive means; and decoupling means including an actuating device controlled by said switching means so as to be simultaneously actuated and deactuated with said drive means, said actuating device comprising means for electromagnetically moving an armature, and a connecting rod having one end connected to said armature and another end, said decoupling means also including a decoupling unit operated by said actuating device for disengaging said coupling means upon elapse of a time interval following actuation of said actuating device, said decoupling unit comprising a blocking member having two arms, one arm of which is connected to the other end of said connecting rod, said blocking member being a lever movable between respective positions in which said blocking member lies in and out of the path of movement of said engaging element.

4. A sewing machine as defined in claim 1, wherein said coupling means comprises a pair of clutch elements disposed intermediate the shaft and said drive means, a movable engaging element located intermediate said clutch elements, and means for mounting said engaging element for movement between respective positions in which said engaging element is in and out of frictional engagement with said clutch elements.

5. A sewing machine as defined in claim 4, wherein said actuating means comprises means for electromagnetically moving said armature; and wherein said decoupling means comprises a blocking member connected to said armature and being movable between respective positions in which said blocking member lies in and out of the path of movement of said engaging element.

6. A sewing machine as defined in claim 5, wherein said blocking member is a two-armed lever; and further comprising a connecting rod having one end connected to one arm of said lever and its other end connected to said armature.

7. A sewing machine as defined in claim 1, wherein said switching means comprises a pedal switch.

8. A sewing machine as defined in claim 7, wherein said switching means further comprises an electrical multiposition switch electrically connected in series with said pedal switch, said multi-position switch having a movable arm which is mounted for displacement between two first positions for high-speed and for low-speed continuous operation respectively, and a second position for intermittent operation.

9. A sewing machine as defined in claim 8, wherein said actuating means and said drive means are electrically connected in series when said movable arm is positioned in said second switching position.

10. A sewing machine as defined in claim 8, wherein said actuating means and said drive means are always electrically connected in series.

11. A sewing machine as defined in claim 8; and further comprising resistive-type diodes mounted intermediate said pedal switch and said drive means so as to reduce the rotary speed at which the shaft is rotated.

12. A sewing machine as defined in claim 7, wherein said switching means further comprises an electrical position switch electrically connected in series with said pedal switch, said multi-position switch having a movable arm which is mounted for displacement between two first positions for high-speed and for low-speed continuous operation respectively; and further comprising a discrete switch electrically connected intermediate said actuating means and said movable arm.

13. A sewing machine as defined in claim 8; and further comprising another electrical multi-position switch also electrically connected in series with said pedal switch and having a movable arm, said movable arm of said first-mentioned multi-position switch being connected with said drive means and said movable arm of said other multi-position switch being connected with said actuating means; and further comprising means for moving both of said movable arms together as a unit.

14. A sewing machine as defined in claim 13, wherein said drive means and said actuating means are connected in parallel.

* * * * *